US006786288B2

(12) United States Patent
Singh

(10) Patent No.: US 6,786,288 B2
(45) Date of Patent: Sep. 7, 2004

(54) CUTTING STRUCTURE FOR ROLLER CONE DRILL BITS

(75) Inventor: Amardeep Singh, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/931,467

(22) Filed: Aug. 16, 2001

(65) Prior Publication Data

US 2003/0034176 A1 Feb. 20, 2003

(51) Int. Cl.[7] ..... E21B 10/00
(52) U.S. Cl. ..... 175/353; 175/355; 76/108.2
(58) Field of Search ..... 175/350, 353, 175/355, 356, 331, 336, 337; 76/108.2, 108.1

(56) References Cited

U.S. PATENT DOCUMENTS

| | | | | |
|---|---|---|---|---|
| 4,256,194 A | * | 3/1981 | Varel | 175/375 |
| 4,580,642 A | * | 4/1986 | Gosch | 175/57 |
| 4,611,673 A | | 9/1986 | Childers et al. | 175/340 |
| 4,741,406 A | | 5/1988 | Deane et al. | 175/340 |
| 5,311,958 A | | 5/1994 | Isbell et al. | 175/341 |
| 5,372,210 A | | 12/1994 | Harrell | 175/431 |
| 6,095,262 A | | 8/2000 | Chen | 175/57 |
| 6,167,975 B1 | | 1/2001 | Estes | 175/331 |
| 6,213,255 B1 | | 4/2001 | Neuwirth | 188/71.9 |
| 6,345,673 B1 | * | 2/2002 | Siracki | 175/353 |
| 2002/0079138 A1 | * | 6/2002 | Xiang | |

FOREIGN PATENT DOCUMENTS

| | | | |
|---|---|---|---|
| GB | 2 370 591 | 7/2002 | E21B/10/08 |

OTHER PUBLICATIONS

United Kingdom Patent Office Search Report dated Nov. 26, 2002, 2 pages.

* cited by examiner

*Primary Examiner*—David Bagnell
*Assistant Examiner*—Zakiya Walker
(74) *Attorney, Agent, or Firm*—Osha Novak & May L.L.P.

(57) ABSTRACT

The invention is directed to a roller cone drill for drilling earth formations and a method of using the same. The drill bit includes a bit body and a plurality of roller cones attached to the bit body and able to rotate with respect to the bit body. The drill bit further includes a plurality of cutting elements disposed on each of the roller cones, an offset of at least about 0.375 inches; and a journal angle less than about thirty degrees. In one embodiment, the drill bit includes three roller cones. In another embodiment, the cutting elements of the bit are arranged on each cone so that cutting elements on adjacent cones intermesh between the cones.

3 Claims, 8 Drawing Sheets

CUTTING STRUCTURE FOR ROLLER CONE DRILL BITS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to roller cone drill bits for drilling earth formations, and more specifically to roller cone drill bit designs.

2. Background Art

Roller cone rock bits and fixed cutter bits are commonly used in the oil and gas industry for drilling wells. FIG. 1 shows one example of a roller cone drill bit used in a conventional drilling system for drilling a wellbore in an earth formation. The drilling system includes a drilling rig (10) used to turn a drill string (12) which extends downward into a wellbore (14). Connected to the end of the drill string (12) is roller cone-type drill bit (20), shown in further detail in FIG. 2.

FIG. 2 shows a roller cone bit (20) that typically comprises a bit body (22) having an externally threaded connection at one end (24), and a plurality of roller cones (26) (usually three as shown) attached at the other end of the bit body (22) and able to rotate with respect to the bit body (22). Disposed on each of the cones (26) of the bit (20) are a plurality of cutting elements (28) typically arranged in rows about the surface of the cones (26). The cutting elements (28) may comprise tungsten carbide inserts, polycrystalline diamond compacts, or milled steel teeth.

Significant expense is involved in the design and manufacture of drill bits to produce drill bits with increased drilling efficiency and longevity. For more simple bit designs, such as fixed cutter bits, models have been developed and used to design and analyze bit configurations having optimally placed cutting elements, a more balanced distribution of force on the bit, and a more balanced distribution of wear on the cone. These force-balanced bits have been shown to be long lasting and effective in drilling earth formations.

Roller cone bits are more complex in design than fixed cutter bits, in that the cutting surfaces of the bit are disposed on roller cones. Each of the roller cones independently rotates relative to the rotation of the bit body about an axis oblique to the axis of the bit body. Because the roller cones rotate independent of each other, the rotational speed of each cone is likely different. In some configurations, the cutting elements on the drive row are located to drill the full diameter of the bit. In such cases, the drive row may be interchangeably referred to as the "gage row".

Adding to the complexity of roller cone bit designs, cutting elements disposed on the cones of the roller cone bit deform the earth formation by a combination of compressive fracturing and shearing. Additionally, most modern roller cone bit designs have cutting elements arranged on each cone so that cutting elements on adjacent cones intermesh between the adjacent cones, as shown for example in FIG. 3A and further detailed in U.S. Pat. No. 5,372,210 to Harrell. Intermeshing cutting elements on roller cone drill bits is desired to permit high insert protrusion to achieve competitive rates of penetration while preserving the longevity of the bit. However, intermeshing cutting elements on roller cone bits substantially constrain cutting element layout on the bit, thereby further complicating the designing of roller cone drill bits.

Because of the complexity of roller cone bit designs, accurate models of roller cone bits have not been widely developed or used to design roller cone bits. Instead, roller cone bits have been largely developed through trial and error. For example, if it has been shown that a prior art bit design leads to cutting elements on one cone of a bit being worn down faster that the cutting elements on another cone of the bit, a new bit design might be developed by simply adding more cutting elements to the faster worn cone in hopes of reducing wear on each of the cutting elements on that cone. This trial and error method of designing roller cone drill bits has led to roller cone bits with cutting elements unequally distributed between the cones. In some prior art bit designs, the unequal distribution of the number of cutting elements between the cones may result in an unequal distribution of force, strain, stress, and wear between the cones, which can lead to the premature failure of one of the cones. In other prior art bit designs, the unequal distribution of the number of cutting elements between the cones may result in an unequal distribution of contact with the formation between the cones or an unequal distribution of volume of formation cut between the cones.

One example of a prior art roller cone bit configuration considered effective in drilling wellbores is shown in FIGS. 3A–3B. In FIG. 3A, the profiles of each of the cutting elements on each cone are shown in relation to each other to show the intermeshing of the cutting elements between adjacent cones. FIG. 3A has three cones (110) a first cone (114), a second cone (116) and a third cone (118). A plurality of cutting elements (112) are on each of the cones (110). The first cone (114) has three rows of cutting elements (112): a first row (114*a*), a second row (114*b*), and a third row (114*c*). The second cone (116) has two rows of cutting elements (112): a first row (116*a*) and a second row (116*b*). The third cone (118) has two rows of cutting elements (112): a first row (118*a*) and a second row (118*b*).

FIG. 3B shows a section of a drill bit that comprises a bit body (100) and three roller cones (110) attached to the bit body (100) such that each roller cone (110) is able to rotate with respect to the bit body (100) about an axis oblique to the bit body (100). Disposed on each of the cones (110) is a plurality of cutting elements (112) for cutting into an earth formation. The cutting elements are arranged about the surface of each cone in generally circular, concentric rows arranged substantially perpendicular to the axis of rotation of the cone. In this example, the rows of cutting elements are arranged so that cutting elements on adjacent cones intermesh between the cones. In this example, the cutting elements (112) comprise milled steel teeth with hardface coating applied thereon.

Although not shown in the drawings, each roller cone (26 in FIG. 2) may be rotatably mounted on a cylindrical bearing journal (not shown) on the bit body (22 in FIG. 2), as is known in the art. As is also known in the art, bearings such as roller bearings, ball bearings, or sleeve bearings may be located between the roller cone (26 in FIG. 2) and the bearing journal (not shown) to provide the rotational mounting.

In FIG. 4A, the roller cones (26) are illustrated schematically as simple frustoconical figures. Each roller cone (26)

has an axis of rotation (32) passing substantially through the center of the frustoconical figure. The central rotational axis (34) of the bit (20 in FIG. 2) is illustrated as point (34) in FIG. 4 (since FIG. 4A is taken from a view looking directly along the rotational axis of the bit). From FIG 4A, it can be seen that because of the offset of axes (32), none of the axes intersect axis (34) of the bit. In this flat projection, the intersection of the axes (32) forms an equilateral triangle. The amount of offset for a bit is the distance from axis (34) to the mid-point of any side of triangle. In the prior art, the amount of offset was typically less than about 1/32 inch of offset per inch of bit diameter. It was believed that offsets greater than that amount would cause high wear of gage elements resulting in loss of rate of penetration.

FIG. 5A is a cone profile which is an overlay in a single plane of one-half of all of the three roller cones (26) to indicate the journal angle (36) of the bit. The journal angle (36) is the angle that the bearing journal axis, which coincides with the rotational axis (32) of the roller cone (26), makes with a plane normal to the bit rotational axis (34). In the prior art, the journal angle was typically greater than about 32.5°. It was believed that journal angles smaller than that amount could result in poor wear properties of the cutting element materials and breakage of the bit body (22).

U.S. Pat. No. 4,611,673, issued to Childers et al., discloses a roller cone drilling bit comprising a plurality of conical roller cutters having hard metal cutting elements thereon and being so positioned relative to each other that their rotational axes are offset from the rotational axis of the drill bit, and a drilling fluid nozzle system for directing a pressurized fluid stream across certain of the cutting elements and thereafter against the formation generally at the bottom of the wellbore so that when the drill bit is used in its most advantageous areas, such as the soft, medium-soft and plastic formations, the nozzle system prevents "balling up" of the cutters and greatly increases the drilling efficiency of the bit.

U.S. Pat. No. 4,741,406, issued to Deane et al., discloses a tri-cone drill bit comprising a plurality of conical roller cutters having hard metal cutting elements thereon and being so positioned relative to each other that their rotational axes are offset from the rotational axis of the drill bit, and a drilling fluid nozzle system for directing a pressurized fluid stream across certain of the cutting elements and thereafter against the formation generally at the bottom of the wellbore so that when the drill bit is used in its most advantageous areas, such as the soft, medium-soft and plastic formations, the nozzle system prevents "balling up" of the cutters and greatly increases the drilling efficiency of the bit. In one embodiment the drill bit body has vertically extending recessed portions formed at the junctures of the lugs to provide flow passageways for the upward flow of drilling fluid and entrained cuttings.

U.S. Pat. No. 5,311,958, issued to Isbell et al., discloses an earth-boring bit that is provided with three cutters, two of the three cutters are provided with heel disk cutting elements defined by a pair of generally oppositely facing disk surfaces that generally continuously converge to define a circumferential heel disk crest. One of the two cutters having heel disk elements is further provided with an inner disk cutting element.

U.S. Pat. No. 6,095,262, issued to Chen, discloses a roller cone drill bit for drilling through subterranean formations having an upper connection for attachment to a drill string, and a plurality cutting structures rotatably mounted on arms extending downward from the connection. A number of teeth are located in generally concentric rows on each cutting structure. The actual trajectory by which the teeth engage the formation is mathematically determined. A straight-line trajectory is calculated based on the actual trajectory. The teeth are positioned in the cutting structures such that each tooth having a designed engagement surface is oriented perpendicular to the calculated straightline trajectory.

U.S. Pat. No. 6,213,225, issued to Chen, discloses a roller cone drilling wherein the bit optimization process equalizes the downforce (axial force) for the cones. Bit performance is enhanced by equalizing downforce.

SUMMARY OF INVENTION

One aspect of the invention is a roller cone drill bit for drilling earth formations and a method of using the same. The drill bit comprises a bit body and a plurality of roller cones attached to the bit body and able to rotate with respect to the bit body. The drill bit further comprises a plurality of cutting elements disposed on each of the roller cones. The bit has an offset of at least about 0.375 inches; and a journal angle less than about thirty degrees. In one embodiment, the drill bit comprises three roller cones. In another embodiment, the cutting elements of the bit are arranged on each cone so that cutting elements on adjacent cones intermesh between the cones.

Other aspects and advantages of the invention will be apparent from the following description and the appended claims.

BRIEF DESCRIPTION OF DRAWINGS

FIG. 3C is a spacing diagram for a prior art bit.

DETAILED DESCRIPTION

Figure 4A:
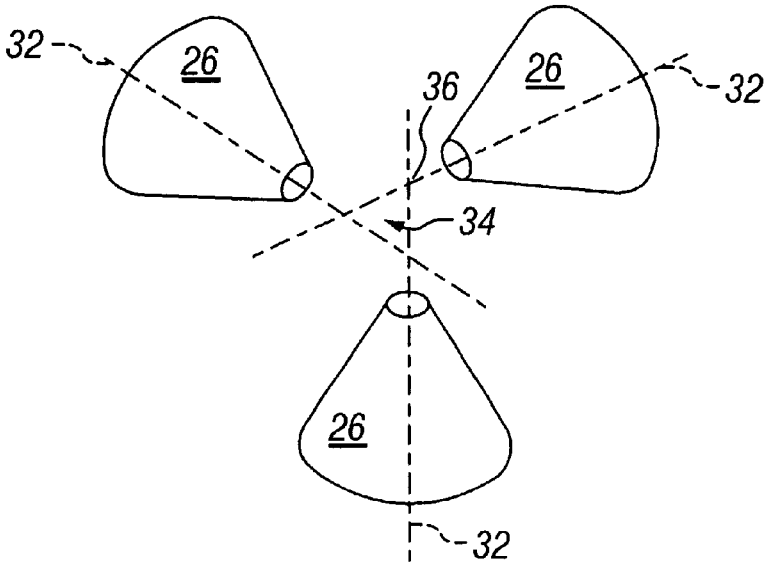
FIG. 4A (Prior Art)
FIG. 4A and B are schematic diagrams demonstrating offset.
Figure 4B:
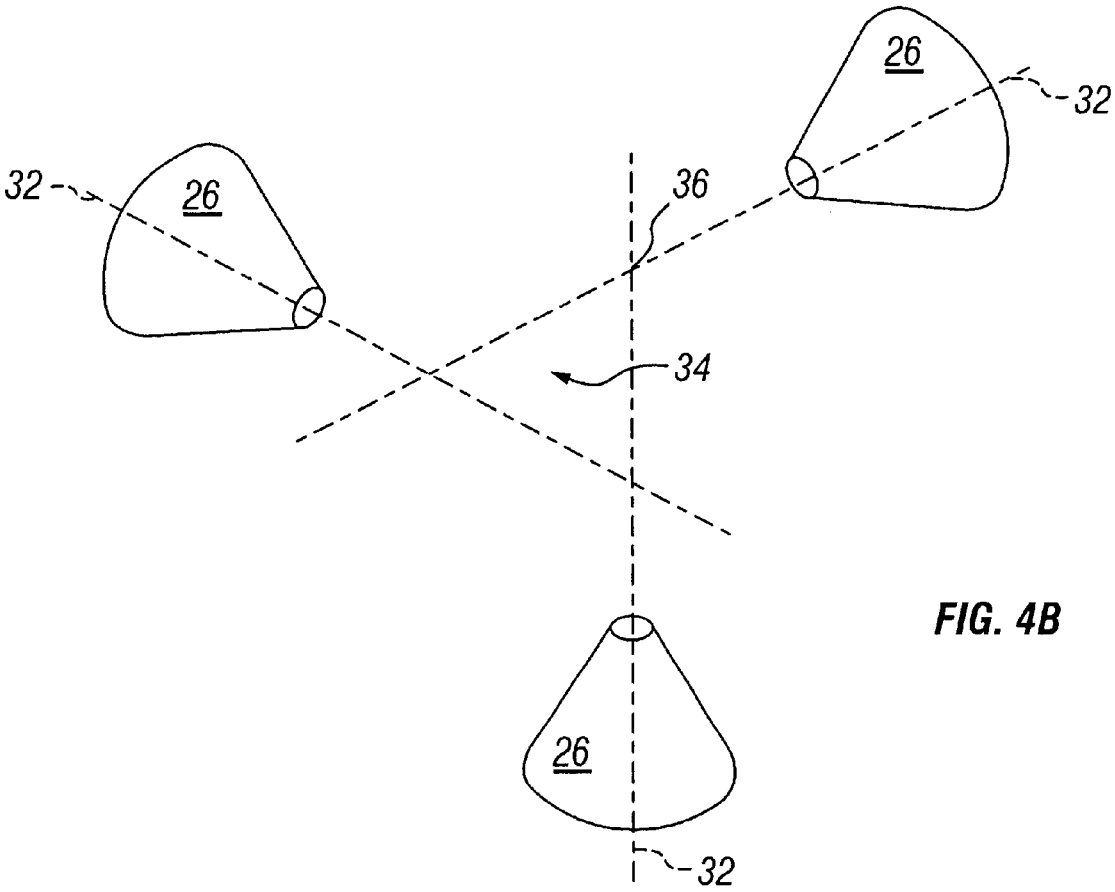
Figure 5A:
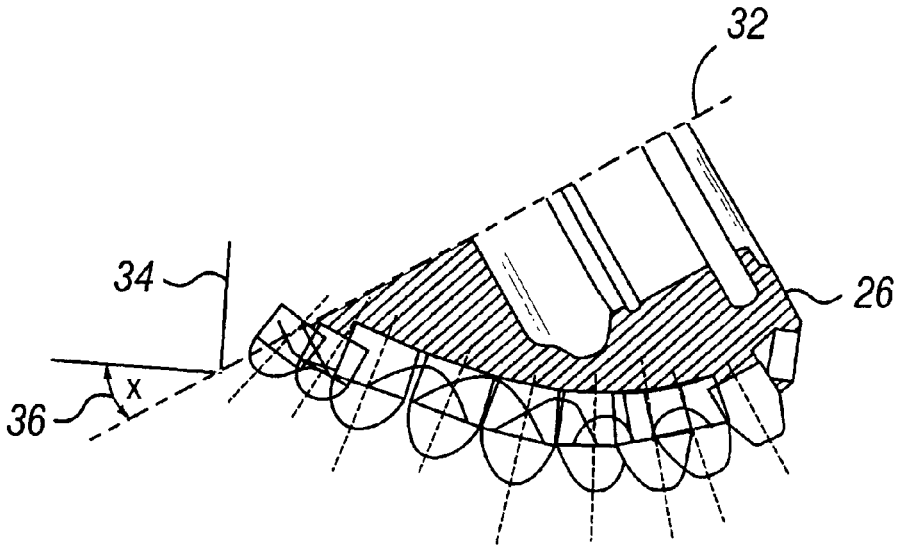
FIG. 5A (Prior Art)
FIG. 5A and B are schematic diagrams demonstrating journal angle.
Figure 5B:
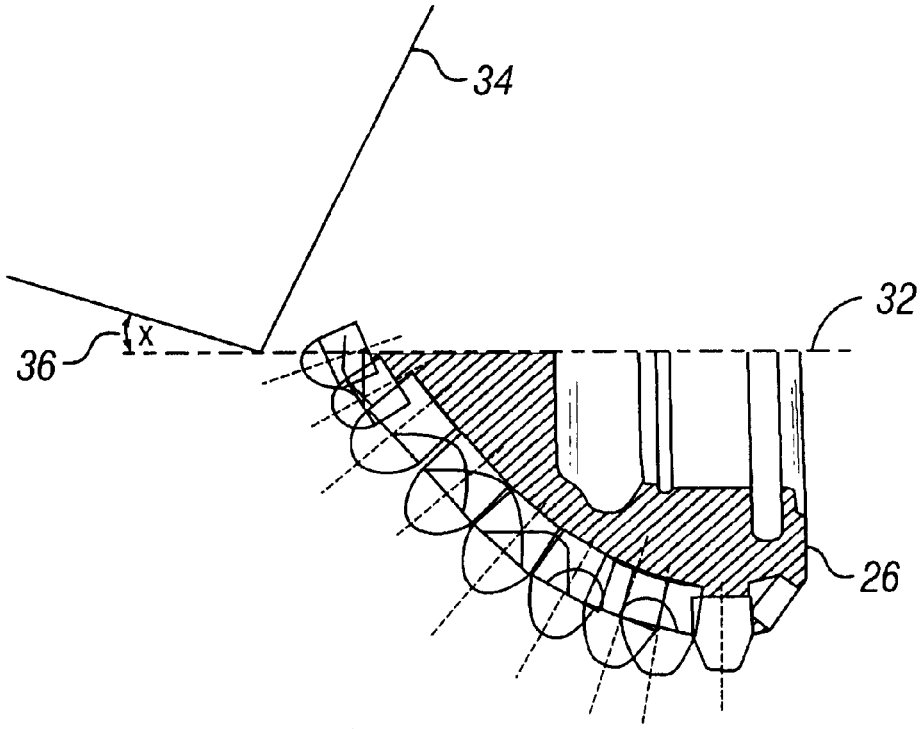
Figure 6:
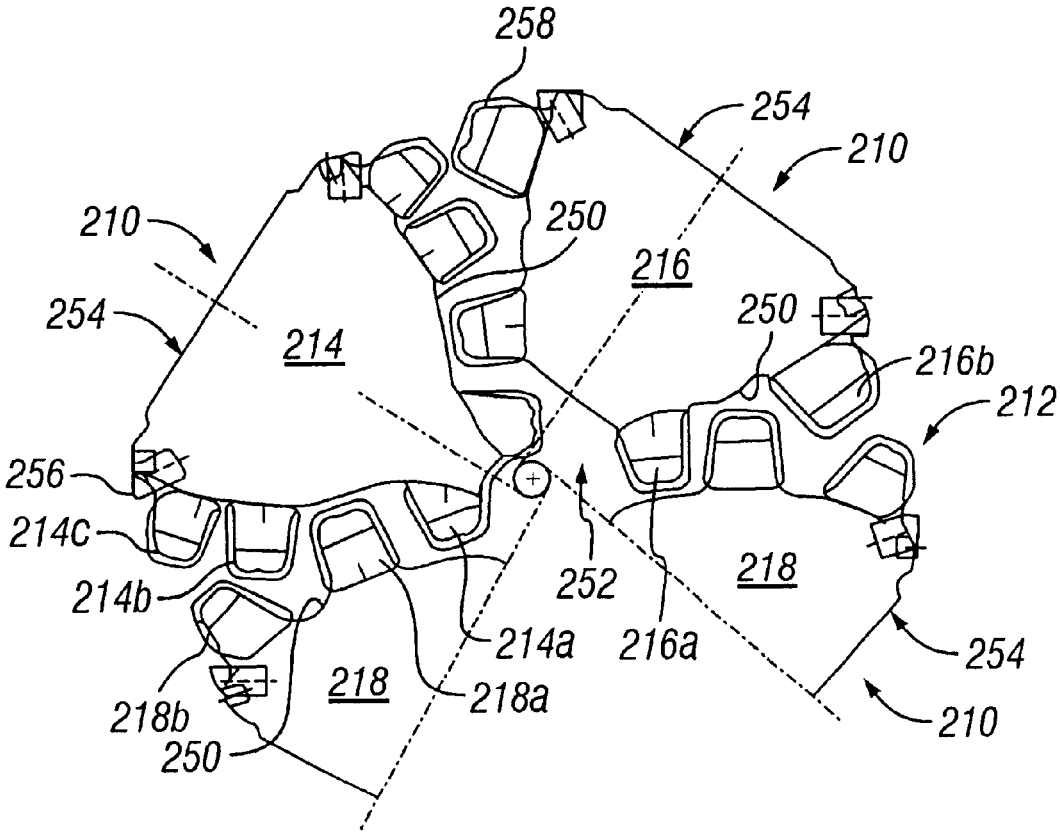
FIG. 6 is a diagram of the roller cones for a bit in accordance with one embodiment of the invention illustrating an intermeshing relationship of the cutting elements between the cones.
Figure 7:
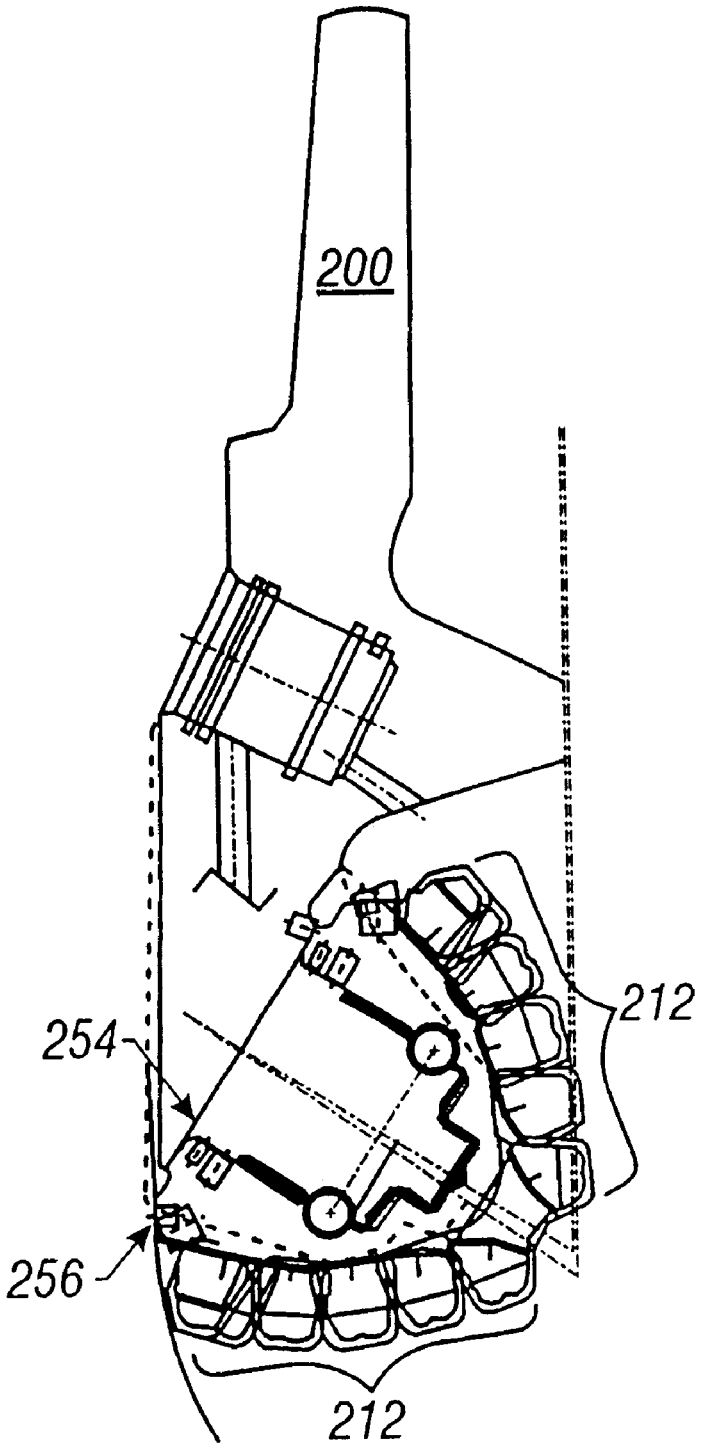
FIG. 7 is a schematic diagram of one leg of a drill bit configured in accordance with one embodiment of the present invention, wherein the effective position of cutting elements on all three cones of the bit are illustrated on the cone shown to illustrate bottomhole coverage of the bit.

Referring to FIGS. 4B, 5B, 6, and-7, in one embodiment, the invention comprises a roller cone bit which includes a bit body (200) (partial view in FIG. 7) and a plurality of roller cones (typically three), collectively referenced as (210) in FIG. 6. Each of the roller cones (210) is attached to the bit body (200) and is able to rotate with respect to the bit body (200). In this embodiment, the cones (210) of the bit include a first cone (214), a second cone (216), and a third cone (218). Each cone (210) includes an exterior surface, generally conical in shape and having a side surface (250). Disposed about the side surface (250) of each of the cones (210) is a plurality of cutting elements, shown generally at (212) and optional additional cutting elements shown at (256). A distinction between cutting elements (212) and cutting elements (256) will be further explained.

In this embodiment, the plurality of cutting elements disposed on each cone are arranged primarily on the side surface (250) of each cone (214), (216), (218), as shown in FIG. 6. In general, at least three different types of cutting elements may be disposed on the cones, including primary cutting elements, generally indicated as (212), gage cutting elements, generally indicated as (256) and ridge cutting elements (not shown). In the embodiment of FIG. 6, primary cutting elements (212) are the cutting elements generally arranged about the conical surface (250) of the cones and used as the primary means for cutting through the bottom-hole surface of the earth formation. Optional gage cutting elements (256) are cutting elements which scrape the wall of the wellbore to maintain the diameter of the wellbore. Gage cutting elements (256) are typically arranged in one or more rows about the lower edge of one or more cones as shown at (256) in FIGS. 6 and 7. Rows of gage cutting elements are typically referred to as "gage rows", "heel rows" or "trucut" rows. Optional ridge cutting elements (not shown) are miniature cutting elements, or hardened material deposits that are, optionally, disposed about the surface of the cone, typically between the primary cutting elements (212), to protect the cone surface and cut formation ridges which pass between cutting elements on the cones. Ridge cutting elements are used to reduce damage or wear of the cone surface by reducing contact between the cone surface and formation ridges.

In another embodiment, the cutting elements may comprise only primary cutting elements (212), or primary cutting elements (212) and, optionally, gage (256), and/or ridge cutting elements. Further, while primary cutting elements (212) and gage cutting elements (256) are shown as distinctly different sets of cutting elements for the previous embodiment, it should be understood that in other embodiments, one or more primary cutting elements (212) may be arranged on one or more cones to essentially perform as a gage cutting element. The types and combinations of cutting elements used is a matter of choice for the bit designer and are not intended as a limitation on the invention.

FIG. 6 shows the cone and cutting element configurations for an embodiment of the invention illustrating the location of the primary cutting elements (212) on each cone. In this embodiment, the primary cutting elements (212) are arranged on each cone so that primary cutting elements (212) on adjacent cones form an intermeshing cutting element pattern between the cones, as shown in FIG. 6. The primary cutting elements in this embodiment, comprise milled steel teeth. These teeth (212) are generally arranged in circular, concentric rows about the conical side surface (250) of each cone, as shown in FIG. 6. On the first cone (214) the teeth (212) are arranged in three rows (214*a*), (214*b*) and (214*c*). On the second cone (216) the teeth (212) are arranged in two rows (216*a*) and (216*b*). On the third cone (218) the teeth (212) are arranged in two rows, (218*a*) and (218*b*).

In other embodiments, the number of rows of cutting elements (212) on the conical side surface (250) of each cone may be between zero and four rows per cone. In another embodiment, the number of rows of cutting elements (212) on the conical side surface (250) of each cone may be between one and three rows per cone.

In one embodiment, the primary cutting elements (212), as previously explained, comprise milled steel teeth formed on the cones. In one embodiment, hardface coating (258) may be applied to the teeth to produce a tooth cutting structure with increased hardness. In another embodiment, the teeth may comprise milled steel teeth without hardface coating applied thereon. In another embodiment, the primary cutting elements (212) may comprise inserts. The inserts may be made from hard or superhard materials and combinations thereof. Suitable materials may include tungsten carbide, diamond, boron carbide, silicon carbide, diamond-tungsten carbide matrix, cubic boron nitride, polycrystalline diamond, boron tetracarbide, tantalum carbide, vanadium carbide, niobium carbide, halfnium carbide, zirconium carbide, and mixtures thereof.

Figure 1:
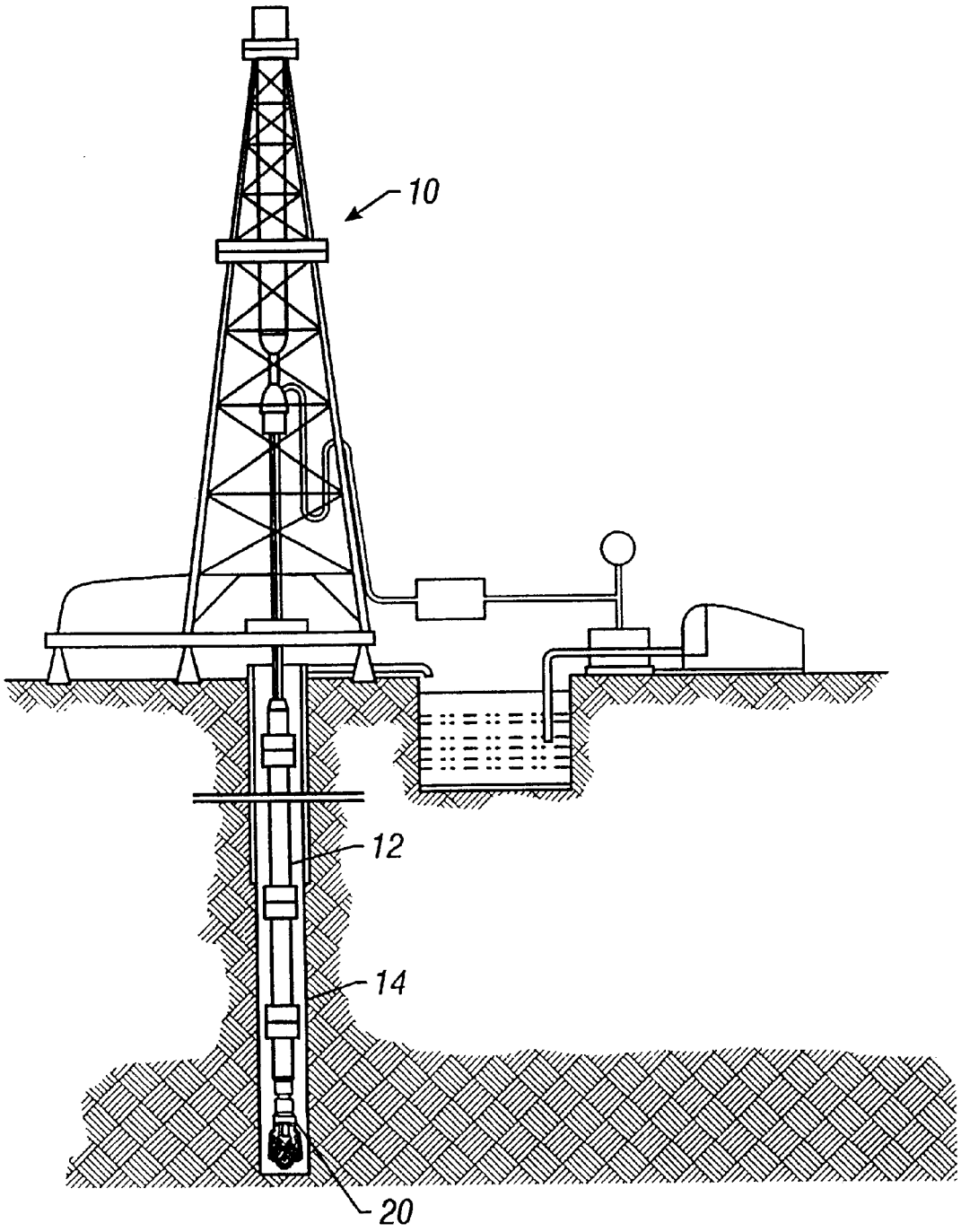
FIG. 1 (Prior Art)
FIG. 1 shows a schematic diagram of a drilling system for drilling earth formations.
Figure 2:
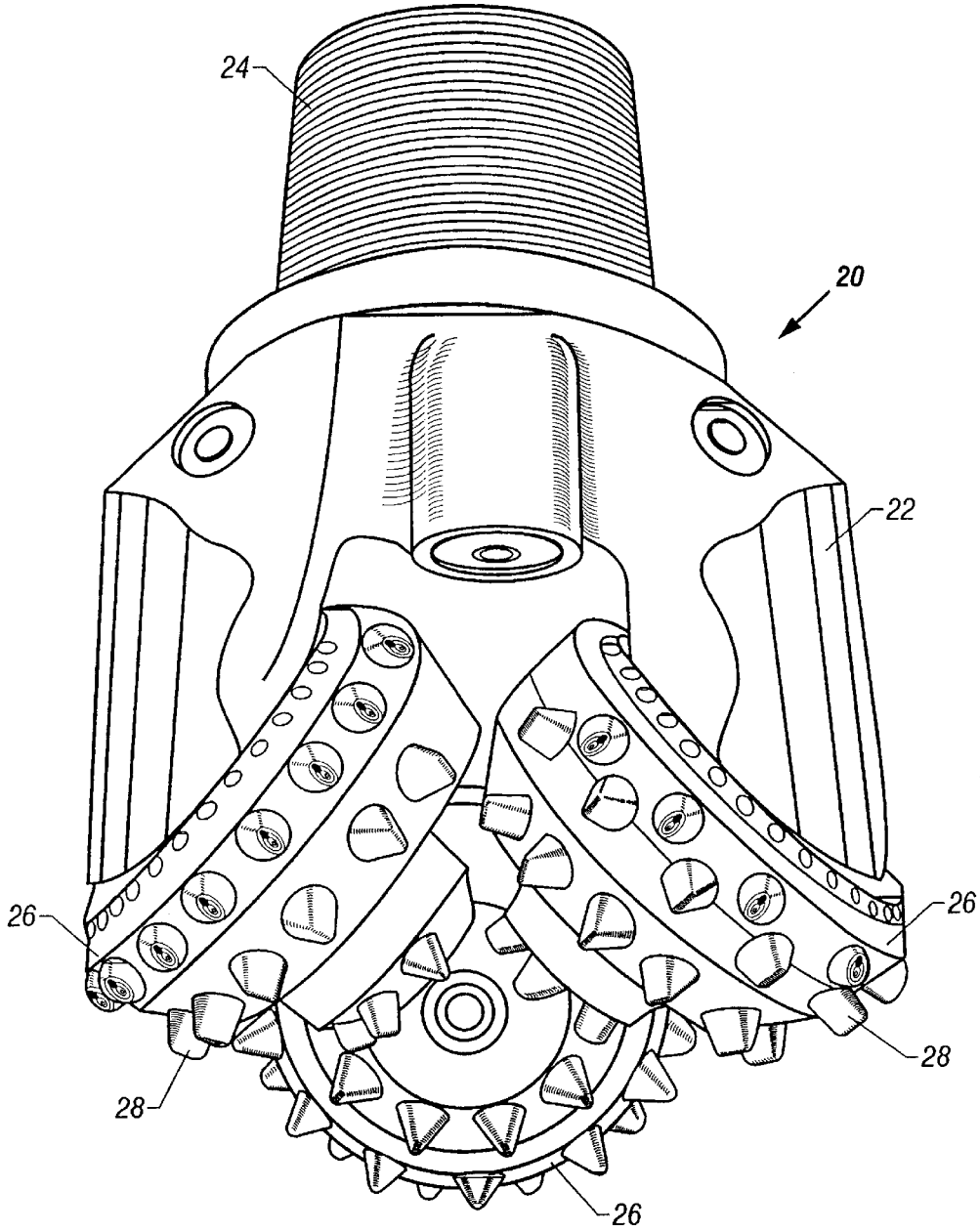
FIG. 2 (Prior Art)
FIG. 2 shows a perspective view of a prior art roller cone drill bit.
Figure 3A:
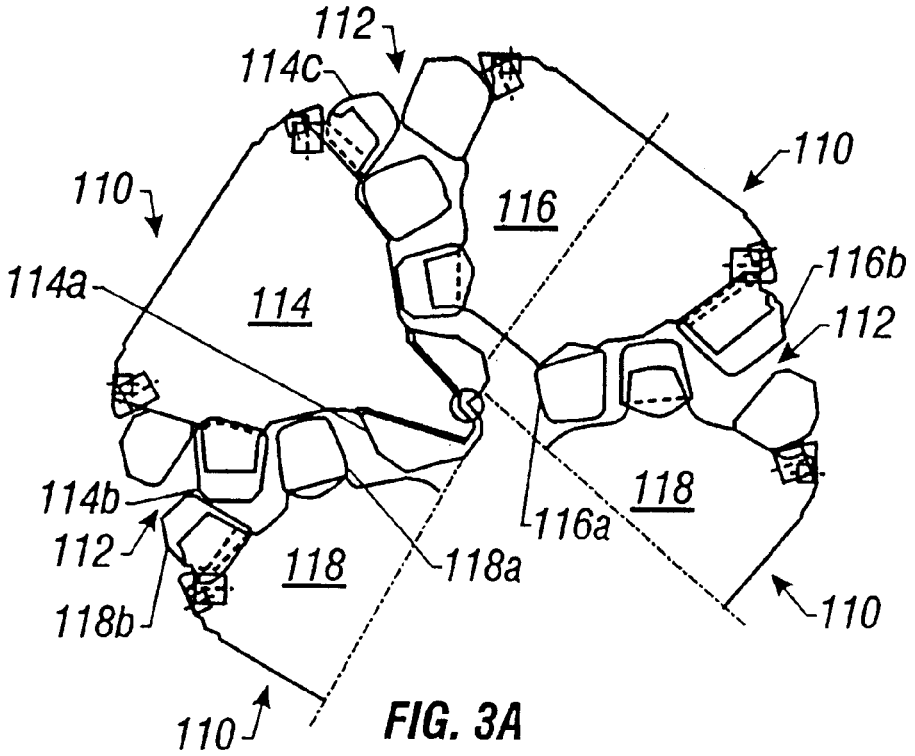
FIG. 3A (Prior Art)
FIG. 3A is a diagram of the roller cones of a prior art drill bit illustrating the intermeshing relationship of the cutting elements between the cones.
Figure 3B:
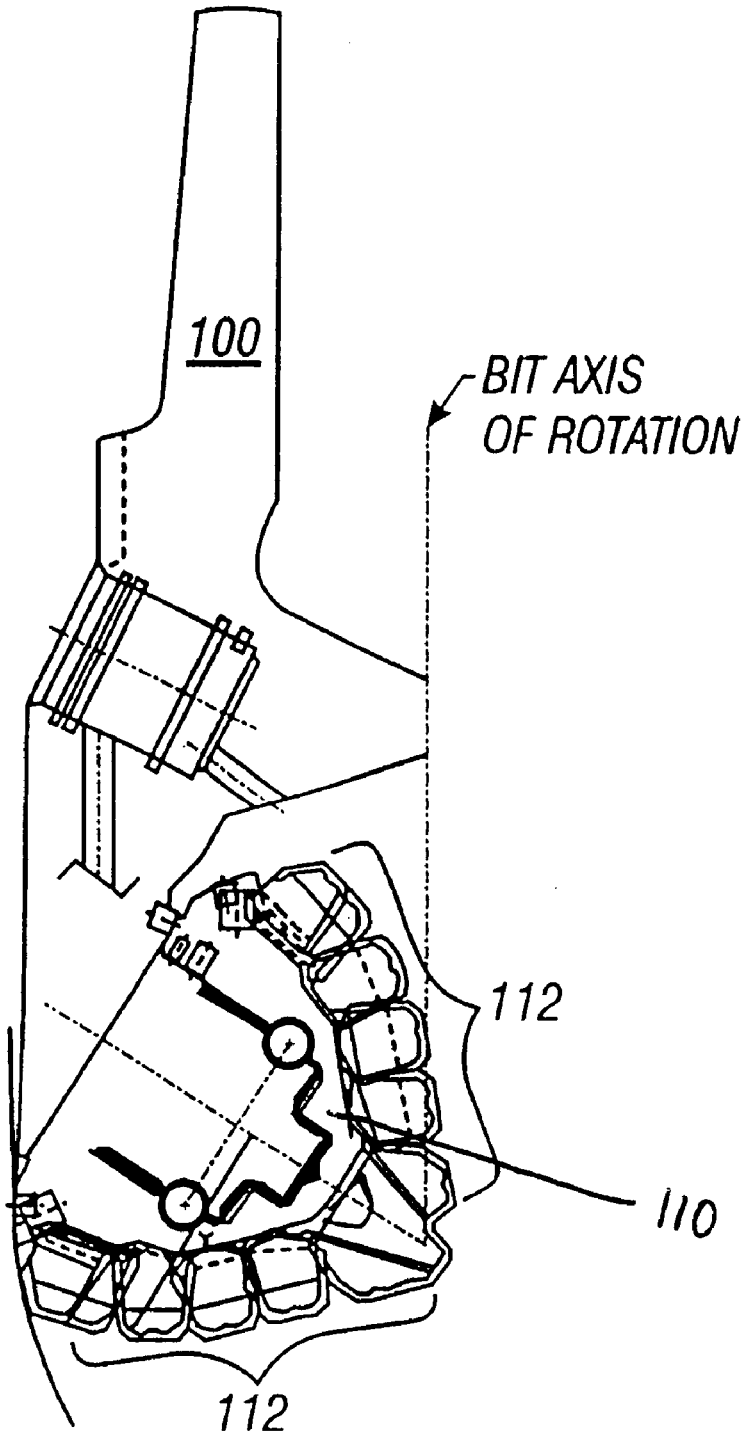
FIG. 3B (Prior Art)
FIG. 3B is a schematic diagram of one leg of a prior art bit wherein the effective position of cutting elements on all three cones of the bit are illustrated on the cone shown to illustrate bottomhole coverage of the bit.

In one embodiment of the invention, as shown in FIG. 2, the cutting elements (28) have an axial crest. Axial crests are so called because the crest generally is substantially aligned with the axis of rotation of the cone (26) that the cutting elements is located on. In an alternative embodiment, the cutting elements (28) may have a circumferential crest (not shown). Circumferential crests (not shown) are so called because the crest (not shown) generally is substantially oriented circumferentially about the cone (26) that the cutting element (28) is located on, or substantially aligned with a circumference of the cone (26) that the cutting element (28) is located on. Circumferential crests are disclosed in U.S. Pat. No. 5,311,958 issued to Isbell et al. A circumferential crest (not shown) would have different loading properties and stress distribution than an axial crest because a circumferential crest has a rolling action with the rock formation downhole where only a portion of the crest interacts with the rock formation at one time, while for an axial crest, substantially the entire crest penetrates the rock formation at the same time. In another embodiment of the invention (not shown), the cutting elements (28) have a crest that is neither axial nor circumferential, but the crests are substantially aligned with a line that is between the axis of rotation of the cone (26) that the cutting element is located on and the circumference of the cone (26) that the cutting element is located on. In another embodiment, the crests are substantially aligned with a line that is within about 40° (in any direction) of the axis of rotation of the cone (26) that the cutting element is located on. In another embodiment, the crests are substantially aligned with a line that is within about 30° (in any direction) of the axis of rotation of the cone (26) that the cutting element is located on. In another embodiment, the crests are substantially aligned with a line that is within about 15° (in any direction) of the axis of rotation of the cone (26) that the cutting element is located on.

In one embodiment, the cutting elements are shown in FIG. 2 as arranged in rows on the side surface of each cone. In other embodiments of the invention, cutting elements may be arranged in any number of rows on each of the cones, or the cutting elements may not be arranged in rows, but instead placed in a different configuration about the surface of the cone, such as a staggered arrangement. It should be understood that the invention is not limited to the particular arrangement of the cutting elements shown in FIGS. 6 and 7, but rather the cutting elements may be arranged in any suitable manner as determined by the bit designer without departing from the spirit of the invention.

Further, although a roller cone bit having three cones is shown for this embodiment, it should be understood that the invention is not limited to bits having three roller cones. The invention only requires that the bit have, in one embodiment, at least one cone, and in another embodiment, a plurality of cones, i.e., at least two roller cones. In another embodiment, the drill bit comprises at least three roller cones.

In one embodiment, the cutting elements are arranged in rows on the side surface of each cone as shown in FIG. 2. In one embodiment of the invention, there are three cones and seven or more total rows of cutting elements. In another embodiment of the invention, the cutting elements may be arranged on three cones with less than seven total rows of cutting elements. In another embodiment of the invention, there are six total rows of cutting elements. In another embodiment of the invention, there are five total rows of cutting elements. In another embodiment of the invention, there are four total rows of cutting elements.

Soft formations were originally drilled with "fish-tail" drag bits, which sheared the formation. Fish-tail bits are obsolete, but shear failure is still very useful in drilling soft formations. Roller cone bits designed for drilling soft formations are designed to maximize the gouging and scraping action, in order to exploit both shear and compressive failure. To accomplish this, cones are offset to induce the largest allowable deviation from rolling on their true centers. Journal angles are small and cone-profile angles will have relatively large variations. Cutting elements are long, sharp, and widely-spaced to allow for the greatest possible penetration. Drilling in soft formations is characterized by low weight and high rotary speeds.

In one embodiment of the invention, the scraping distance of the primary cutting elements (212 in FIG. 6) with the rock formation is maximized. An increased scraping distance of the bit will serve to increase the shearing action of the bit. The increased scraping distance of the bit and the increased shearing action of the bit may increase the rate of penetration. The increased scraping distance is achieved by a combination of a low journal angle and a high offset.

In one embodiment of the invention, the journal angle (36) shown in FIG. 5B of the bit is less than about 30°. In another embodiment of the invention, the journal angle (36) shown in FIG. 5B of the bit is less than about 25°. In another embodiment of the invention, the journal angle (36) shown in FIG. 5B of the bit is between about 27° to about 29°.

In one embodiment to the invention, the offset is defined as the distance from the bit's axis (34) to the mid-point of any side of triangle (as seen in FIG. 4B), is at least about 0.375 inches. In another embodiment, the offset is at least 0.45 inches. In another embodiment, the offset is at least about 0.05 inches per inch of bit diameter. In another embodiment, the offset is at least about 0.065 inches per inch of bit diameter.

Referring to FIG 4B, in another embodiment of the invention, the offset is defined as the angle between a cone's axis (32) and a hypothetical cone axis (not shown) that passes through the bit's axis (34). In other words, the offset angle is the angle necessary to rotate the cone (26) so that the cone's axis (32) intersects the bit's axis (34). In one embodiment, the offset angle is at least about 4°. In another embodiment, the offset angle is at least about 5°. In another embodiment, the offset angle is at least about 6°. In another embodiment, the offset angle is from about 4° to about 6°. In one embodiment, the hypothetical axis (not shown) intersects the cone axis (32) at the hole wall, in order to create a pivot point. The pivot point is the point about which the cone axis (32) may be rotatated. In one embodiment, a 8 ½ bit with a 0.375" offset results in about a 5.0 degree offset angle. In another embodiment, a 9⅞bit with a 0.375" offset results in about a 4.3 degree offset angle.

In one embodiment of the invention, the journal angle (36) of the bit (20) is less than about 30°, and the offset is at least about 0.375 inches. In another embodiment, the journal angle (36) of the bit (20) is less than about 25° and the offset is at least about 0.45 inches. In another embodiment, the journal angle (36) of the bit (20) is less than about 30° and the offset is at least about 0.05 inches per inch of bit diameter.

Advantages of the invention include one or more of the following:

A bit with an increased scraping distance of the interior cutting elements rows;

A bit with an increased scraping distance of the exterior cutting elements rows;

A bit with an increased rate of production in soft formations; and

A bit with a more aggressive cutting mechanism.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A roller cone drill bit, comprising:

a bit body;

at least one roller cone attached to the bit body and able to rotate with respect to the bit body;

a plurality of cutting elements disposed on the at least one roller cone;

an offset angle of at least about four degrees; and a journal angle less than about thirty degrees.

2. The drill bit according to claim 1, wherein the offset angle is at least about five degrees.

3. The drill bit according to claim 1, wherein at least one of the cutting elements comprise a circumferential crest.

* * * * *